US008063924B2

(12) United States Patent
Tanaka

(10) Patent No.: US 8,063,924 B2
(45) Date of Patent: Nov. 22, 2011

(54) IMAGE FORMING APPARATUS

(75) Inventor: Kenichi Tanaka, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 899 days.

(21) Appl. No.: 11/873,871

(22) Filed: Oct. 17, 2007

(65) Prior Publication Data

US 2008/0158328 A1 Jul. 3, 2008

(30) Foreign Application Priority Data

Dec. 28, 2006 (JP) ..... 2006-353746

(51) Int. Cl.
*B41J 2/385* (2006.01)

(52) U.S. Cl. ..... 347/130; 347/262

(58) Field of Classification Search ..... 347/130, 347/159, 224, 225, 232, 233, 238, 138
See application file for complete search history.

(56) References Cited

U.S. PATENT DOCUMENTS

| | | | | | |
|---|---|---|---|---|---|
| 3,748,985 | A | * | 7/1973 | Brandt | 362/11 |
| 4,445,128 | A | * | 4/1984 | Dolan et al. | 347/130 |
| 4,447,126 | A | * | 5/1984 | Heidrich et al. | 385/119 |
| 4,515,462 | A | * | 5/1985 | Yoneda | 399/231 |
| 4,777,500 | A | * | 10/1988 | Salmon | 347/55 |
| 4,916,464 | A | * | 4/1990 | Ito et al. | 347/237 |
| 4,926,200 | A | * | 5/1990 | Ohyama et al. | 347/130 |
| 4,963,899 | A | * | 10/1990 | Resch, III | 347/116 |
| 4,994,827 | A | * | 2/1991 | Jamzadeh et al. | 347/116 |
| 4,994,858 | A | * | 2/1991 | Lubberts | 399/164 |
| 5,061,967 | A | * | 10/1991 | Isobe | 399/316 |
| 5,257,567 | A | * | 11/1993 | Walker et al. | 83/74 |
| 5,296,906 | A | * | 3/1994 | Hano et al. | 399/385 |
| 5,321,437 | A | * | 6/1994 | Heeren | 347/139 |
| 5,504,516 | A | * | 4/1996 | Bax | 347/238 |
| 5,642,146 | A | * | 6/1997 | Uchiyama | 347/130 |
| 5,657,066 | A | * | 8/1997 | Adams et al. | 347/198 |
| 5,751,327 | A | * | 5/1998 | De Cock et al. | 347/130 |
| 5,768,675 | A | * | 6/1998 | Estabrooks | 399/385 |

(Continued)

FOREIGN PATENT DOCUMENTS

JP 11-065400 3/1999

(Continued)

OTHER PUBLICATIONS

Notice of Reasons for Refusal mailed Jul. 26, 2011 from Japanese Patent Office in corresponding Japanese Patent Application No. 2006-353746.

*Primary Examiner* — Charlie Peng
*Assistant Examiner* — Peter Radkowski
(74) *Attorney, Agent, or Firm* — Finnegan, Henderson, Farabow, Garrett & Dunner, L.L.P.

(57) ABSTRACT

An image forming apparatus having; a photoconductive drum, a LED print head to write an image on a surface of the photoconductive drum, and a positioning device to locate the LED print head in a relative position in respect to the photoconductive drum, includes; centering sections respectively arranged at both ends of a center shaft of the photoconductive drum so as to rotate centering around the shaft thereof, LED print head positioning members fixed at the centering member respectively, and a rotation direction determination member to fix the centering members onto an image forming apparatus main body side when a preferable relative position of the LED print head in respect to the photoconductive drum is obtained by rotating the centering sections.

9 Claims, 7 Drawing Sheets

U.S. PATENT DOCUMENTS

| | | | | |
|---|---|---|---|---|
| 5,805,197 | A * | 9/1998 | Fleming et al. | 347/237 |
| 5,860,038 | A * | 1/1999 | Kato et al. | 399/49 |
| 5,872,585 | A * | 2/1999 | Donato et al. | 347/218 |
| 5,909,233 | A * | 6/1999 | Hamman et al. | 347/188 |
| 5,926,201 | A * | 7/1999 | Fleming et al. | 347/237 |
| 6,243,128 | B1 * | 6/2001 | Yamakawa | 347/263 |
| 6,711,372 | B1 * | 3/2004 | Noda et al. | 399/286 |
| 2001/0019340 | A1 * | 9/2001 | Kubo et al. | 347/1 |
| 2001/0026312 | A1 * | 10/2001 | Ohba | 347/263 |
| 2002/0012020 | A1 * | 1/2002 | Sarmast et al. | 347/19 |
| 2002/0135665 | A1 * | 9/2002 | Gardner | 347/238 |
| 2004/0042816 | A1 * | 3/2004 | Fukuda et al. | 399/98 |
| 2007/0070166 | A1 * | 3/2007 | Mikami et al. | 347/130 |
| 2007/0126852 | A1 * | 6/2007 | Fukutome et al. | 347/262 |
| 2008/0068839 | A1 * | 3/2008 | Matheson | 362/250 |
| 2009/0154190 | A1 * | 6/2009 | Choi et al. | 362/549 |

FOREIGN PATENT DOCUMENTS

| | | | |
|---|---|---|---|
| JP | 2001125347 | A * | 5/2001 |
| JP | 2005-55781 | | 3/2005 |
| JP | 2005-242119 | | 9/2005 |
| JP | 2005242119 | A * | 9/2005 |
| JP | 2005266279 | A * | 9/2005 |

* cited by examiner

IMAGE FORMING APPARATUS

This application is based on Japanese Patent Application No. 2006-353746 filed on Dec. 28, 2006, in Japanese Patent Office, the entire content of which is hereby incorporated by reference.

BACKGROUND OF THE INVENTION

The present invention relates to an image forming apparatus capable of high accuracy positioning of a process unit representing image forming section equipped with a LED print head.

In color image forming apparatus, the process unit of each color is configured with a photoconductive drum and members arranged at its peripheral such as a charging device, exposing device, developing device and cleaning device, and a degree of parallelization between each member and the photoconductive drum is key issue to improve sharpness of an image and stability of reproducibility. In color image forming particularly, adjustment of the position by individual process unit is needed first. Further the degree of parallelization between each process unit is important to prevent occurrence of color skew of the image. As Patent Document 1 disclose, it has been popular that the degree of parallelization in respect to the photoconductive drum is maintained, for example, by adjusting the position of the LED print head serving as an exposing device via a frame portion which is coaxially connected to a rotation center of the photoconductive drum, in other words based on the frame portion. However, even by the above adjusting method, there is a case where the process unit is slightly deformed when the photoconductive drum and its drive mechanism, a developing roller, and a screw and its drive mechanism are assembled and connected. Thus the position LED print head is misaligned and the degree of parallelization is deteriorated. Further when the process unit is deformed with time, the accuracy of parallelization is further deteriorated.

Once the degree of parallelization in respect to the photoconductive drum is deteriorated, the process unit had to be dismantled from the image forming apparatus main boy so that the each member is reassembled and adjusted. Also, it was inconvenient that when the LED print head is replaced, the apparatus had to be carried into a maintenance room to carry out adjusting work, thus field service was extremely difficult.

Also, in order to prevent such phenomenon, described in the Patent Document 2, ensuring of the degree of parallelization in respect to the photoconductive drum is attempted to maintain, for example, by pressing a partial cylindrical section of a position setting section where a LED print head setting section and a developing device setting section are integrated, onto a cylindrical section of the photoconductive drum having the same diameter. However, since the position setting section and the photoconductive drum abut each other in sliding manner, it is not preferable as a positioning means and the degree of parallelization cannot be maintained stably.

Patent Document 1: Tokkai 2005-55781

Patent Document 2: Tokkai 2005-242119

SUMMARY OF THE INVENTION

An object of the present invention is to provide an image forming apparatus wherein the degree of parallelization between the photoconductive drum and the LED print head is maintained stably for a long period of time.

The above object can be achieved by the following structure.

An image forming apparatus includes a image forming section having; a photoconductive drum, a LED print head to write an image on a surface of the photoconductive drum, and a positioning device to maintain a certain degree of parallelization and a certain distance of the LED print head in respect to the photoconductive drum, wherein the positioning device has; centering sections, which are respectively arranged at both ends of a center shaft arranged concentrically to the photoconductive drum and supported by image forming apparatus main body side, or both ends of the photoconductive drum adjacent to the shaft thereof, and rotatable centering around the center shaft, LED print head positioning members fixed onto the centering sections; and a rotation direction determination section which is fixed at the image forming apparatus main body side in a relative position where a certain degree of parallelization of a light emitting surface of the LED print head in respect to the surface of the photoconductive drum is obtained by relatively rotating each centering section.

In the present invention, image forming apparatus main body side means a frame structure outside the unit. In the following embodiments, it means a housing to store the image forming section and can be an image forming apparatus main body.

BRIEF DESCRIPTION OF THE DRAWINGS

FIG. 2(*b*) is a view of a rotation direction determination section taken on line m to m.

DETAILED DESCRIPTION OF THE PREFERRED EMBODIMENT

The following will describe the image forming apparatus related to the present invention with reference to the drawings.

Figure 1:
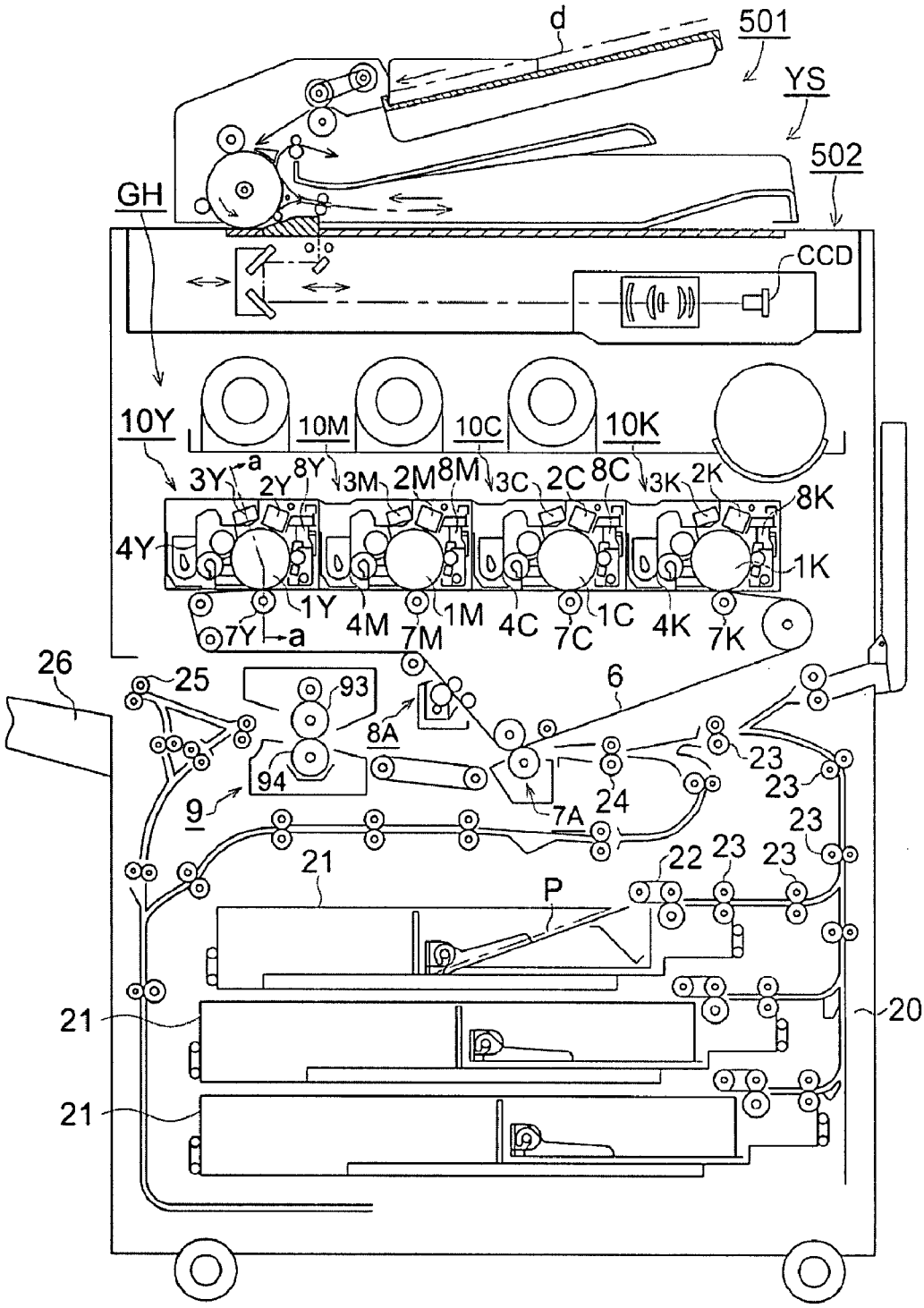
FIG. 1 is a schematic front view of an image forming apparatus related to the present invention.

FIG. 1 is schematic front view of an image forming apparatus related to the present invention. However, the image forming apparatus of the present invention is not limited to the embodiments below.

The present image forming apparatus is configured with an image forming apparatus main body GH and an image scanning apparatus YS.

The image forming apparatus main body GH is a so-called "a tandem type color image forming apparatus" configured with a plurality of sets of image forming sections 10Y, 10M, 10C and 10K, an intermediate transfer substance 6 in a shape of belt, a transfer section 7A, a sheet feeding section 20 and fixing device 9.

Above the image forming apparatus main body GH, the image scanning apparatus YS configured with an automatic document feeding device 501 and a scanning device 502 are disposed. A document d placed on a document table of the automatic document feeding device 501 is conveyed through conveyance rollers, then one surface or both surfaces of the document is exposed by scanning through an optical system of the scanning device 502 to be read by a line image sensor CCD.

A signal formed by photoelectric conversion of the line image sensor CCD is transmitted to exposing devices 3Y, 3M, 3C and 3K after analogue processing, AD conversion, shading compensation, and image compression processing are carried out.

The image forming section 10Y to form a yellow (Y) color image is provided with a charging device 2Y, exposing device 3Y, developing device 4Y and cleaning device 8Y at a peripheral of the photoconductive drum 1Y. The image forming section 10M to form a magenta (M) color image is provided with a charging device 2M, exposing device 3M, developing device 4M and cleaning device 8M at a peripheral of the photoconductive drum 1M. The image forming section 10C to form a cyan (C) color image is provided with a charging device 2C, exposing device 3C, developing device 4C and cleaning device 8C at a peripheral of the photoconductive drum 1C. The image forming section 10K to form a black (Bk) color image is provided with a charging device 2K, exposing device 3K, developing device 4K and cleaning device 8K at a peripheral of the photoconductive drum 1K.

Meanwhile, the developing devices 4Y, 4M, 4C, and 4K include a binary developer composed of a small diameter toner and a carrier.

The intermediate transfer substance 6 trains about a plurality of rollers to be supported in a rotation manner.

In the present embodiment, a heat roller fixing device is employed as the fixing device 9, which is provided with a fixing roller 93 having a heater, a pressing roller 94 to press the fixing roller 93 to heat, press and fix the toner image on a sheet P at a nip section formed between the fixing roller 93 and the pressing roller 94.

Thereby, the image of each color formed by image forming sections 10Y, 10M, 10C and 10K is primary transferred subsequently by transfer sections 7Y, 7M, 7C, and 7K onto the intermediate transfer belt 6 being rotated so that a color toner image in which the toner images of respective colors are superimposed is formed.

One piece of sheet P is separated from the sheets P stored in a sheet feeding cassette 21 by a feeding roller 22 of a feeding section 20, and fed to a resist roller 24 in a stopped state. Then the sheet P is stopped once, and fed to the transfer section 7A by starting rotation of the resist roller 24 at a timing where a front end of the sheet P aligns with a position of the toner image on the intermediate transfer substance 6 so that the color image is secondary transferred onto the sheet P. The sheet P on which the color image is transferred is heated and pressed in the fixing device so that the color image is fixed onto the sheet P. Thereafter, the sheet P is pinched by a discharging rollers 25 to be loaded on a discharge sheet tray 26 outside the apparatus.

On the other hand, after the transfer section 7*a* transfers the color toner image onto the sheet P, the sheet P is separated from the intermediated transfer substance 6 by curvature, then the remaining toner on the intermediated transfer substance 6 is removed by cleaning device 8A.

While, the above is the image forming apparatus to form the color image, it can be an image forming apparatus to form a monochrome image.

In the embodiment of the present invention, while a heat roller fixing device is employed as the fixing device 9, a belt fixing device can be employed.

In the present invention, a LED print head representing a exposing head provided with a LED array where a plurality of LED elements are arranged is employed for exposing devices 3Y, 3M, 3C and 3 K in respective image forming sections 10Y, 10M, 10C and 10K. Therefore, in the following description, they are not referred as exposing devices 3Y, 3M, 3C, and 3K but are explicated as the LED print heads 3Y, 3M, 3C and 3K.

The degree of parallelization of LED print heads 3Y, 3M, 3C and 3K respectively corresponding to photoconductive drums 1Y, 1M, 1C and 1K is important. Accordingly, in the present invention a structure where adjustment of the degree of parallelization and distance between the photoconductive drums and devices such as the charging device, the developing device and the cleaning blade of the cleaning device is easy can be realized.

A detailed description of the above will now be given as follow.

Meanwhile, as FIG. 1 shows, since 4 sets of image forming sections 10Y, 10M, 10C and 10K for respective colors Y, M, C and K have a common structure, the image forming section 10Y of Y color will be mainly described as a representative in the following description of the image forming section.

Figure 2:
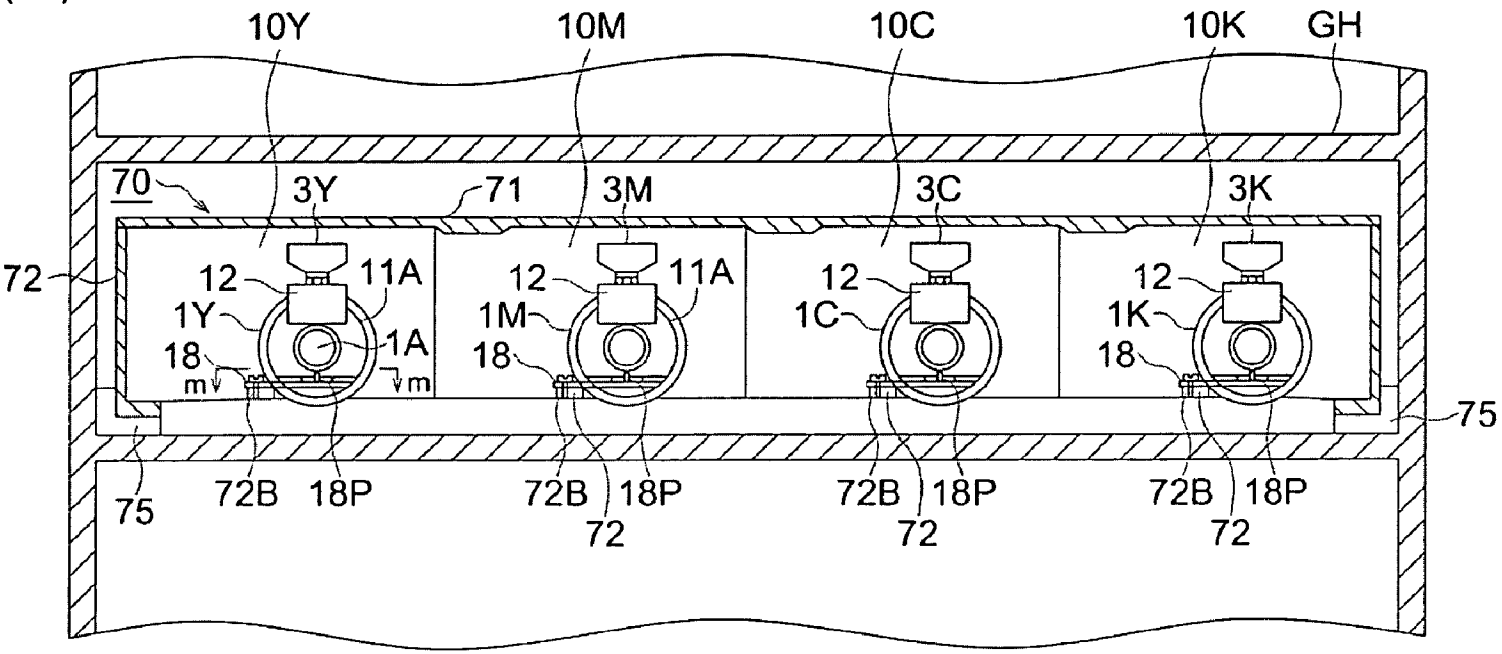
FIG. 2(*a*) is a front view of the image forming section solely describing a relation ship between a photoconductive drum and a LED print head.
Figure 2:
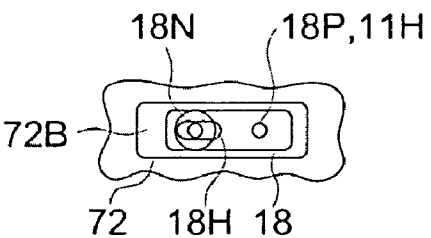

FIG. 2(*a*) is a front view of the image forming section solely indicating a relation between the photoconductive drum and the LED print head and FIG. 2(*b*) is a view of a rotation direction determination section taken on line m to m.

Figure 3:
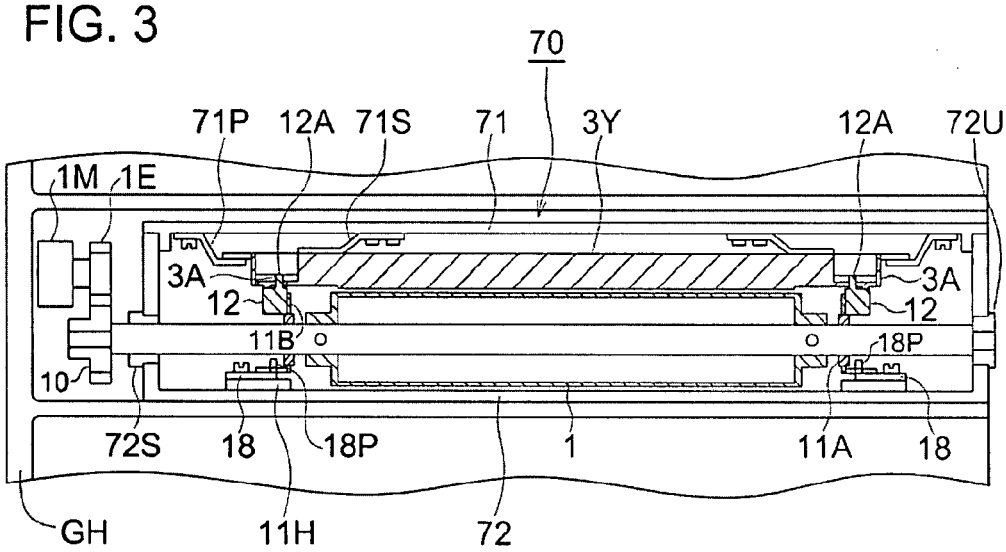
FIG. 3 is a side cross-section of a image forming section.
Figure 4:
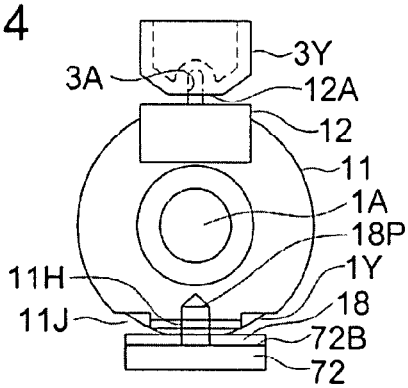
FIG. 4 is a front view where most of a housing 70 is cut out.
Figure 5:
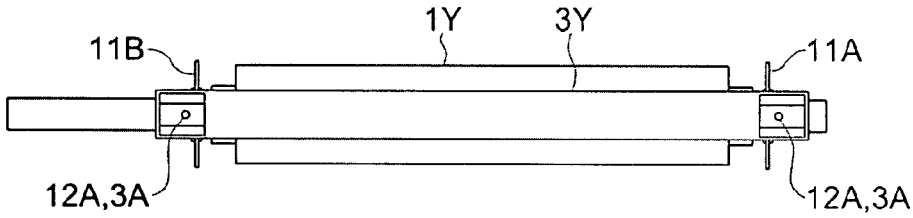
FIG. 5 is a top view of FIG. 4.
Figure 6:
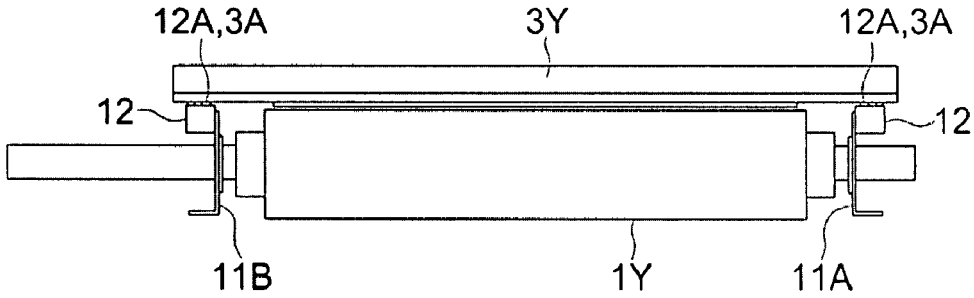
FIG. 6 is a side view of FIG. 4.
Figure 7:
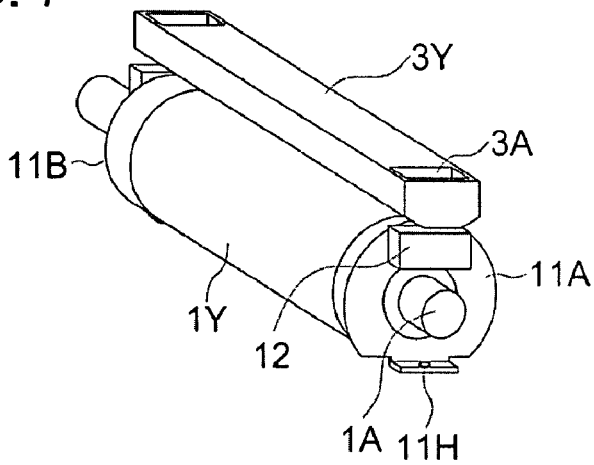
FIG. 7 is a perspective view of FIG. 4.

FIG. 3 is a cross-sectional view showing a part of image forming section 10Y of FIG. 2. The image forming section 10Y is lied horizontally with other image forming sections 10M, 10C and 10K in the housing 70 of the image forming apparatus main body side. At the peripheral of the photoconductive drum 1Y, the charging device, exposing device, developing device and cleaning device are provided. To make the description simple, the devices except for LED print head 3Y are eliminated from the drawing. FIG. 4 is a cross-sectional view of FIG. 1 taken from line a to a which is a front view of the housing 70 which are cut out mostly in FIG. 2 and FIG. 3. Also, FIG. 5 is a top view of the drawing thereof and FIG. 6 is a side view and FIG. 7 is a perspective view of the drawing thereof.

The photoconductive drum 1Y integrated with its center axis 1A is arranged rotatably centering around bearing 72S and 72U of housing section 72 of housing 70. Also, a drive gear 1D is provided at an end of the center shaft 1A, and a gear 1E engaging to the gear thereof is directly connected with a direct current motor 1M. The motor 1M is fixed onto the image forming apparatus GH.

A centering sections 11A and 11B are disposed outside the both ends of the photoconductive drum 1Y and are fitted with the center shaft 1A rotatably.

Also, both ends of the LED print head 3Y are suspended by an engaging member 71P provided at a lid 71 of the housing 70. While maintaining flatness, the LED print head 3Y is pressed downward through a plate spring 71S serving as a bias member mounted on the lid 71 by closing the lid 71. Also at both ends of the LED print head 3Y, there is provided channels 3A to which lugs 12A of LPH positioning members 12 attached to the centering sections 11A and 11B abut as a specific portion.

Also, the rotation direction determination section 18, where respective centering sections 11A and 11B are connected with holes 11H of the jointing sections 11J through a pin 18P inserted to the hole thereof, slides on an adjusting slide surface 72B of the housing section 72.

Thereby, respective centering sections 11*a* and 11B rotate relatively, then at a related position where the degree of parallelization is established, the rotation direction determination section 18 is fixed on the adjusting surface 72B of the housing 72 by a screw 18N through a long hole 18H of the rotation direction determination section 18.

The housing 70 can be withdrawn from image forming apparatus main body GH through the slide rail 75, leaving the direct current motor 1M and the gear 1E directly connected the motor thereof.

In such status, assembling and maintenance/inspection work is carried out easily by removing the lid 71 from the housing 70. Also, adjustments of the degree of parallelization and the distance between the photoconductive drum 1Y and the LED print head 3Y can be carried out after the housing 70 is stored in the image forming apparatus main body GH through the slide rail 75.

Figure 8:
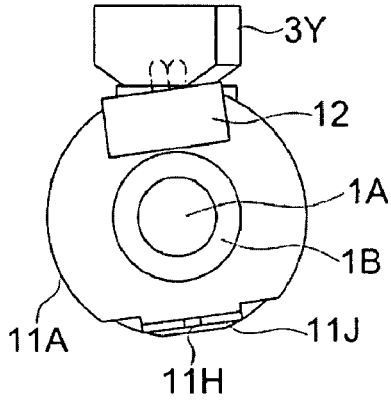
FIG. 8 is an exaggerated front view showing a skewed state before the degree of parallelization is adjusted.
Figure 9:
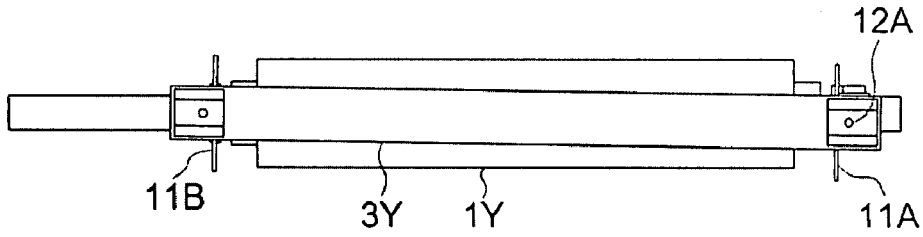
FIG. 9 is a top view of FIG. 8
Figure 10:
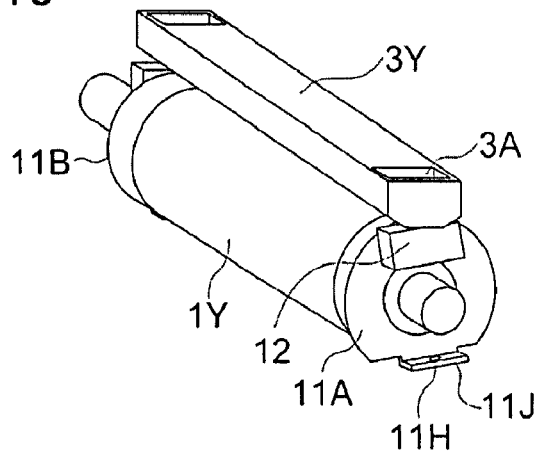
FIG. 10 is a perspective view of FIG. 8.

FIG. 8 is an exaggerated front view showing a skewed status before adjusting the degree of parallelization. FIG. 10 is a perspective view of the view thereof. For the apparatus in such condition as above, firstly, the centering section 11B on the left side (in the back) and the rotation direction determination section 18 are fixed by the hole 11H of the jointing section 11J and the pin 18P fitted thereto after rough rotation adjustment. Next, the centering section 11A on the right side (in front) and the rotation direction determination section 18 are fixed by the hole 11H of the jointing section 11J and the pin 18P fitted thereto after adjusting the degree of parallelization between the photoconductive drum 1Y and the LED print head 3Y by rotating and adjusting the centering section 11A in respect to the centering section 11B.

During the adjustment, while confirming the adjustment, a precise adjustment can be carried out based on detection of the skew by printing a line image on the sheet P.

Also, as another adjusting method, adjustment can be carried out by detecting a time difference of density detection where a line image in a width direction on the belt representing intermediate transfer substance 6 is detected by density sensors disposed respectively at both ends of the belt. This means that at a time point where the time difference is not present, the adjustment is completed.

Figure 11:
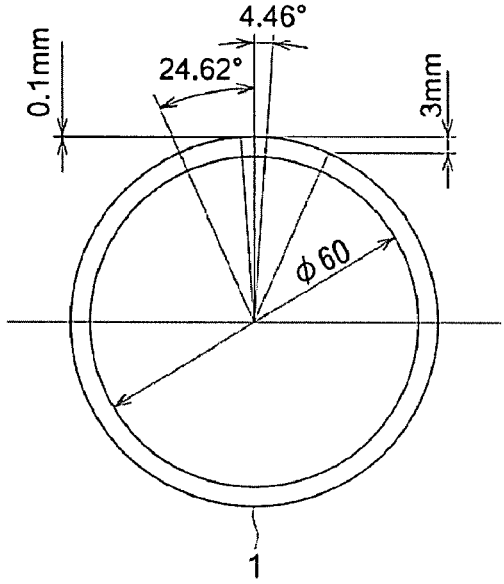
FIG. 11 is a diagram showing dimensional relations of adjustment between a photoconductive drum 1Y and LED print head 3Y.

Meanwhile, as a dimensional relation diagram of FIG. 11 shows, the gap between the photoconductive drum 1Y and a light emitting surface of the LED print head 3Y is 3 mm and a tolerance across the overall length is 0.1 mm. If it is converted into a skew angle at both ends, it is 4.46 degrees. Also if the skew angle becomes 24.62 degree, the photoconductive drum 1Y and the LED print head 3Y come in contact at a midportion. Thus the sliding range of the pin 18 is limited so that the adjusting amount does not exceed an angle limit during the adjustment.

The distance adjustment is performed in a way that a convex section and a concave section of the contact section 3A provided at both end sections of the LED print head 3Y come in contact with a top step and a lower step respectively, and are urged by plate springs 71S provided at the lid 71 of the housing 70.

Figure 12:
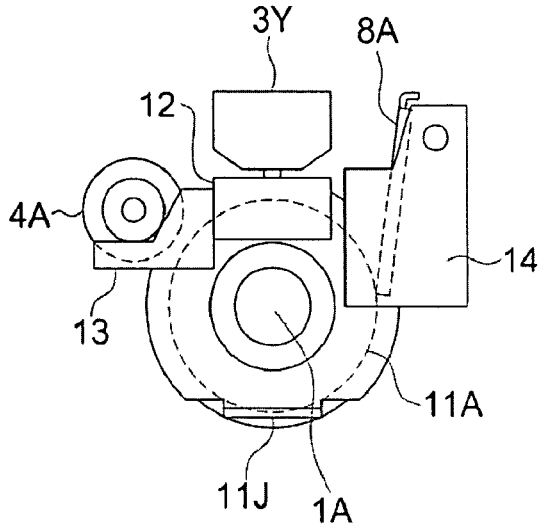
FIG. 12 is a front view showing an adjusting mechanism for degree of parallelization and distances of a developing roller and a cleaning blade in respect to a photoconductive drum.
Figure 13:
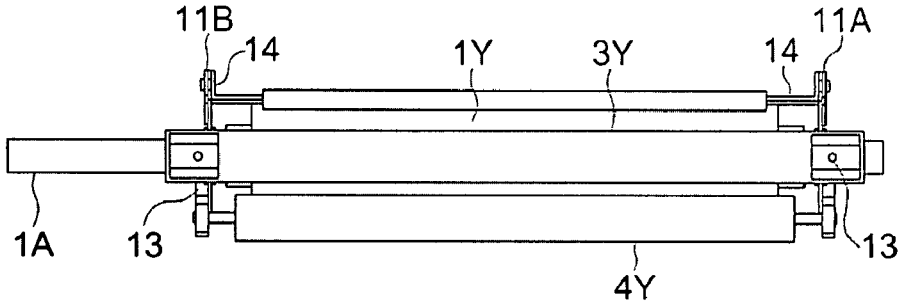
FIG. 13 is a top view of FIG. 12.
Figure 14:
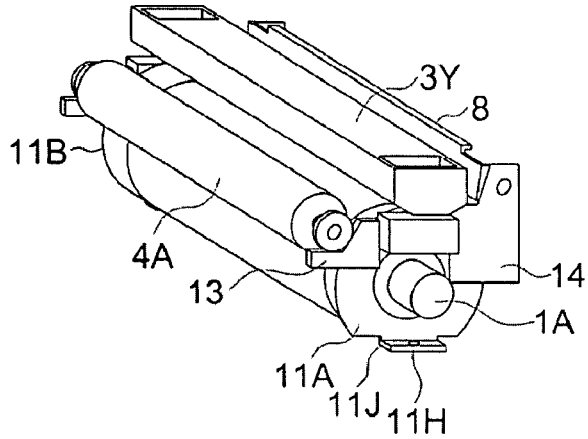
FIG. 14 is a perspective view of FIG. 12.

The adjustment of distance and the degree of parallelization between the photoconductive drum 1Y and the LED print head 3Y is described as above. Next, with reference to a front view of FIG. 12, a top view of FIG. 13 and a perspective view of FIG. 14, the following describes that according to the present invention, the adjustment of distance and degree of parallelization in respect to the photoconductive drum 1Y can be correctly carried out not only for the LED print head 3Y but developing devices at peripheral of the photoconductive drum 1Y such as developing member representing a developing roller and a cleaning device 8, in particular a cleaning blade 8A representing a cleaning member.

As described above, the centering sections 11A and 11B are provided near both ends of the center shaft 1A of the photoconductive drum 1Y. The LPH positioning members 12 are disposed at the centering sections 11A and 11B rotatably and concentrically in respect to center shaft 1A of the photoconductive drum 1Y. And the LPH positioning members 12 are mounted respectively in positions where phase angles and distances in a radial direction in respect to each of centering sections 11A and 11B are the same.

Also, the positioning members 13 of the developing roller 4A of developing device 4Y are respectively mounted and positioned at each of centering sections 11A and 11B so that the positioning member 13 of the developing roller 4A of developing device 4Y maintains a predetermined distance between the photoconductive drum 1Y and between the LED print head 3Y.

Further, a positioning members 14 for a holder of the cleaning blade 8A is fixed in an accurate dimension in respect to each of centering sections 11A and 11B so that the cleaning device 8, in particular the cleaning blade 8A, comes in contact with the photoconductive drum 1Y at each of its free edges on both sides.

With this structure, by carrying out the adjustment of the degree of parallelization and the distance between the photoconductive drum 1Y and the LED print head 3Y, the degree of parallelization and the distances between the developing roller 4A of developing device 4Y and cleaning device 8 particularly cleaning blade 8A, and the photoconductive drum 1Y can be determined automatically.

Figure 15:
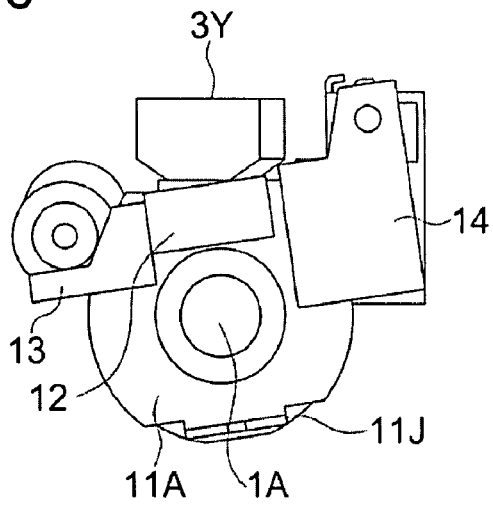
FIG. 15 is a front view showing a state where degree of parallelization and distances of a developing roller and a cleaning blade in respect to the photoconductive drum are deviated.
Figure 16:
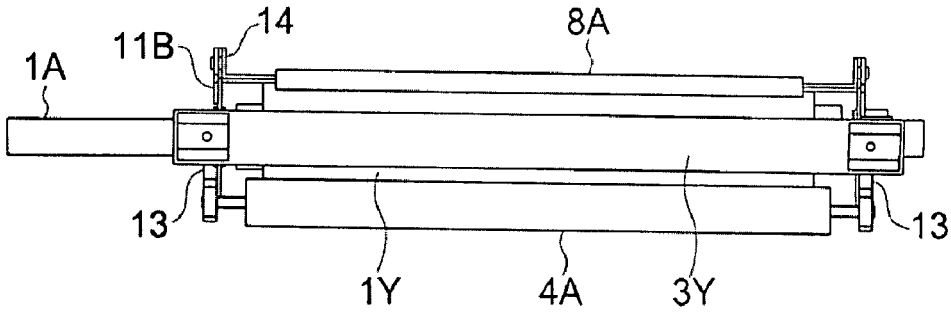
FIG. 16 is a top view of FIG. 15.
Figure 17:
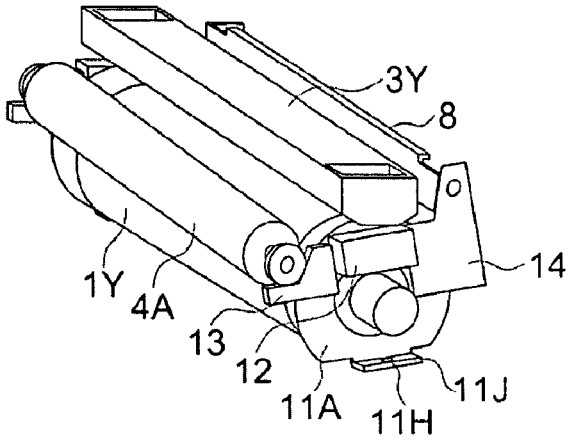
FIG. 17 is a perspective view of FIG. 15.

Therefore, as the front view of FIG. 15, the top view of FIG. 16 and the perspective view of FIG. 17 show, a state where phases of ends of devices are skewed each other can be corrected easily and accurately.

In the above description, while an explanation for adjustment of functions of the charging device 2Y located at the peripheral of the photoconductive drum 1Y was omitted, it is obvious that these adjustments can be carried out in the same manner.

While the image forming section 10Y has been described in the above, the image forming section 10M, 10C and 10K can be adjusted in exactly the same manner since the structures thereof are exactly the same. As a result, with the above adjustment, high quality color images in-focus can be obtained.

According the above embodiments, the degree of parallelization and the distance between the LED print head and the photoconductive drum can be adjusted easily and accurately with the simple structure. Also, at maintenance or replacing members, highly accurate adjustment of the degree of parallelization and the distance can be realized with a simple operation without dismantling the process unit including the LED print head. Therefore the image forming apparatus where a high resolution color image having sharpness and high reproducibility without occurrence of color shift can be provided.

What is claimed is:

1. An image forming apparatus, comprising:

an image forming section having:

a photoconductive drum, an LED print head to write an image on a surface of the photoconductive drum, and a positioning section to maintain a certain degree of parallelization and a certain distance of the LED print head with respect to the photoconductive drum, having:

a centering section engaging in a rotation manner at an end of a rotation axis of the photoconductive drum or an end of the photoconductive drum so as to move an end of the LED print head along a circular arc substantially concentrically to the rotation axis of the photoconductive drum;

an LED print head positioning member fixed onto the centering section for positioning the LED print head; and a rotation direction determination section which is arranged at the image forming apparatus main body side for fixing the centering section after rotating the centering section so that the certain degree of parallelization of a light emitting surface of the LED print head with respect to the surface of the photoconductive drum is obtained;

wherein an adjustment of the degree of the parallelization is achieved by rotating the centering section in a direction of a circumference of the photoconductive drum so as to correct a twisted relationship between a longitudinal direction of the LED print head and a longitudinal direction of the photoconductive drum after the LED print head is positioned on the LED print head positioning member, and the centering section is fixed by the rotation direction determination section after the adjustment.

2. The image forming apparatus of claim 1, further comprising:

a first contact section provided at an end of the LED print head corresponding to a second contact section which is provided at the LED print head positioning member, a bias device provided at the image forming apparatus main body side for engaging the first contact section and the second contact section so that the certain distance is determined.

3. The image forming apparatus of claim 1, wherein the centering section is rotatable in a range where the LED print head does not come in contact with a surface of the photoconductive drum.

4. The image forming apparatus of claim 1, wherein the adjustment of the degree of parallelization is carried out by relatively rotating the centering section in the direction of the circumference of the photoconductive drum so that a right image is obtained based on a tilt of a print line image obtained at the adjustment, and by fixing the rotation direction determination section after moving and adjusting the rotation direction determination section.

5. The image forming apparatus of claim 1, further comprising:

an intermediate transfer belt on which line images are drawn;

a plurality of sensors arranged at both ends of the intermediate transfer belt in a width direction, wherein a position of the centering section is adjusted to be a correct position when tilt of the line images on the intermediate transfer belt is read without time difference by the sensors.

6. An image forming apparatus, comprising:

an image forming section having:

a photoconductive drum, an LED print head to write an image on a surface of the photoconductive drum, and a positioning section to maintain a certain degree of parallelization and a certain distance of the LED print head with respect to the photoconductive drum, having:

a centering section engaged in a rotation manner at an end of a rotation axis of the photoconductive drum or an end of the photoconductive drum so as to move an end of the LED print head along a circular arc substantially concentrically to the rotation axis;

an LED print head positioning member fixed onto the centering section for positioning the LED print head;

a positioning member for determining a position of any one of a developing member, a cleaning member and a charging device, which are in contact with the positioning member; and a rotation direction determination section which is arranged at the image forming apparatus main body side, for fixing the centering section after rotating the centering section so that the certain degree of parallelization of a light emitting surface of the LED print head with respect to the surface of the photoconductive drum is obtained;

wherein an adjustment of the degree of the parallelization is achieved by rotating the centering section in a direction of a circumference of the photoconductive drum so as to correct a twisted relationship between a longitudinal direction of the LED print head and a longitudinal direction of the photoconductive drum after the LED print head is positioned on the LED print head positioning member, and the centering section is fixed by the rotation direction determination section after the adjustment, and wherein the positioning member is fixed onto the centering section so that a degree of parallelization of any one of the developing member, the cleaning member and the charging device, with respect to the photoconductive drum is adjusted at the same time by the adjustment of the degree of parallelization of a light emitting surface of the LED print head with respect to a surface of the photoconductive drum by rotating the centering section in the direction of the circumference of the photoconductive drum.

7. The image forming apparatus of claim 6, further comprising:

a first contact section provided at an end of the LED print head corresponding to a second contact section which is provided at the LED print head positioning member, a bias device provided at the image forming apparatus main body side for engaging the first contact section and the second contact section so that the certain distance is determined;

wherein a distance from any one of the developing member, the cleaning member and the charging device, to the photoconductive drum is adjusted at the same time by the adjustment of the degree of parallelization of a light emitting surface of the LED print head with respect to a surface of the photoconductive drum by rotating the centering section in the direction of the circumference of the photoconductive drum.

8. The image forming apparatus of claim 6, further comprising:

a joint mechanism configured by members in convex and concave shape fit each other, wherein the centering section and the rotation direction determination section are connected through the joint mechanism, and the rotation direction determination section is fixed onto the image forming apparatus main boy side after being slidably adjusted with respect to the image forming apparatus main body side.

9. The image forming apparatus of claim 8, wherein the centering section has a rotation prevention device against a rotation direction of image forming.

* * * * *